US011032648B2

(12) United States Patent
Zhang

(10) Patent No.: US 11,032,648 B2
(45) Date of Patent: Jun. 8, 2021

(54) ELECTROACOUSTIC SOUND GENERATOR

(71) Applicant: AAC Acoustic Technologies (Shenzhen) Co., Ltd., Shenzhen (CN)

(72) Inventor: Guqing Zhang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/679,328

(22) Filed: Nov. 11, 2019

(65) Prior Publication Data

US 2020/0154210 A1 May 14, 2020

(30) Foreign Application Priority Data

Nov. 12, 2018 (CN) ..... 201821866877.9

(51) Int. Cl.

| | |
|---|---|
| ***H04R 9/06*** | (2006.01) |
| ***H04R 7/12*** | (2006.01) |
| ***H04R 9/02*** | (2006.01) |
| ***H04R 1/02*** | (2006.01) |
| ***H04R 7/18*** | (2006.01) |

(52) U.S. Cl.

CPC ..... *H04R 9/06* (2013.01); *H04R 1/023* (2013.01); *H04R 7/127* (2013.01); *H04R 7/18* (2013.01); *H04R 9/025* (2013.01); *H04R 2400/11* (2013.01)

(58) Field of Classification Search

CPC combination set(s) only.
See application file for complete search history.

(56) References Cited

U.S. PATENT DOCUMENTS

| | | | | |
|---|---|---|---|---|
| 9,025,808 | B2 * | 5/2015 | Kwon | H04R 9/043 381/398 |
| 10,321,224 | B2 * | 6/2019 | Li | H04R 9/06 |
| 10,524,032 | B1 * | 12/2019 | Gu | H04R 1/021 |
| 10,659,883 | B2 * | 5/2020 | Xiao | H04R 9/06 |
| 10,764,690 | B2 * | 9/2020 | Gu | H04R 1/06 |
| 10,820,075 | B2 * | 10/2020 | Gu | H04R 1/02 |
| 10,820,116 | B2 * | 10/2020 | Gu | H04R 9/025 |
| 2004/0218779 | A1 * | 11/2004 | Fukuyama | H04R 9/02 381/409 |
| 2014/0376766 | A1 * | 12/2014 | Chen | H04R 1/06 381/400 |
| 2016/0112804 | A1 * | 4/2016 | Xiao | H04R 9/025 381/398 |
| 2016/0241938 | A1 * | 8/2016 | Huang | H04R 1/023 |
| 2018/0332397 | A1 * | 11/2018 | Kim | H04R 9/045 |
| 2020/0045391 | A1 * | 2/2020 | Gu | H04R 1/02 |
| 2020/0045460 | A1 * | 2/2020 | Xiao | H04R 9/06 |
| 2020/0053476 | A1 * | 2/2020 | Xiao | H04R 9/043 |

FOREIGN PATENT DOCUMENTS

| | | | | |
|---|---|---|---|---|
| KR | 101538635 | * | 7/2015 | H04R 1/44 |

* cited by examiner

*Primary Examiner* — Fan S Tsang
*Assistant Examiner* — Angelica M McKinney
(74) *Attorney, Agent, or Firm* — W&G Law Group LLP

(57) ABSTRACT

An adhering portion of an electroacoustic sound generator provided by the present disclosure, for engaging a front cover and a diaphragm, includes a thickened layer for coupling with the diaphragm, which effectively avoid the glue from overflowing. The hardness of the front cover is 150~200 HV, which makes it easier to manufacture the thickened layer.

6 Claims, 4 Drawing Sheets

ELECTROACOUSTIC SOUND GENERATOR

FIELD OF THE PRESENT DISCLOSURE

The present disclosure relates to the field of electromagnetic transducers, more particularly to an electroacoustic sound generator having an improved front cover.

DESCRIPTION OF RELATED ART

An electroacoustic sound generator, also named sound generator or speaker, is a very important component equipped in a mobile phone for producing audible sounds. A speaker generally uses a diaphragm to produce vibration and further to generate sounds. In a related sound generator, a frame with an accommodation space is provided to receive a vibration system and to engage with a front cover located above the frame. The vibration system includes a diaphragm. An engaging surface between the front cover and the diaphragm is a planar plane. When the front cover is engaged with the diaphragm by pressing glue disposed therebetween, excessive glue will overflow from the engaging surface, and further adhere some unexpected parts with each other, which badly affect the sound generator and lower the acoustic performance of the sound generator.

Therefore, an improved electroacoustic sound generator which cn solve the above-mentioned problems is desired.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
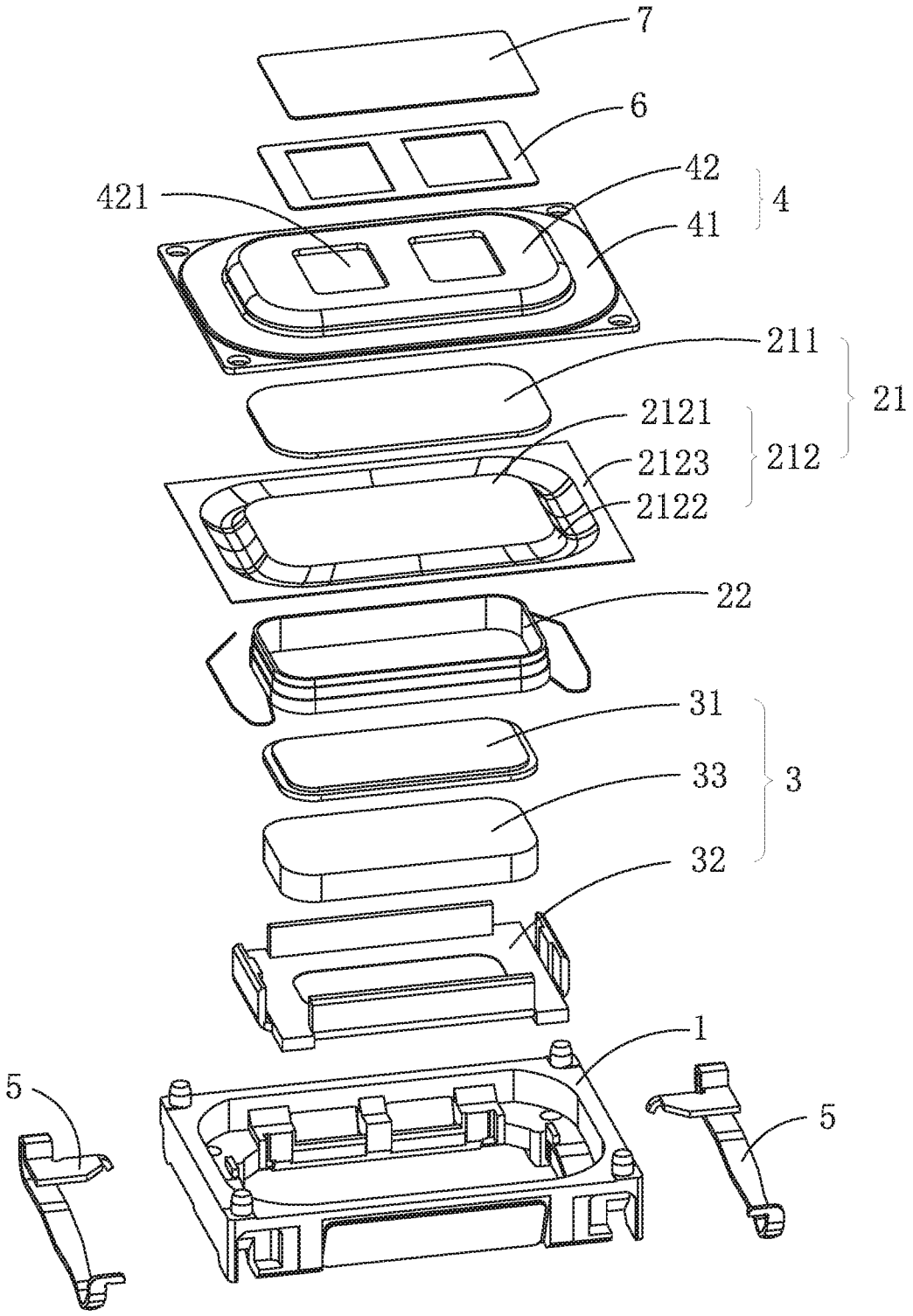
FIG. 1 is an isometric and exploded view of an electroacoustic sound generator in accordance with an exemplary embodiment of the present disclosure.
Figure 2:
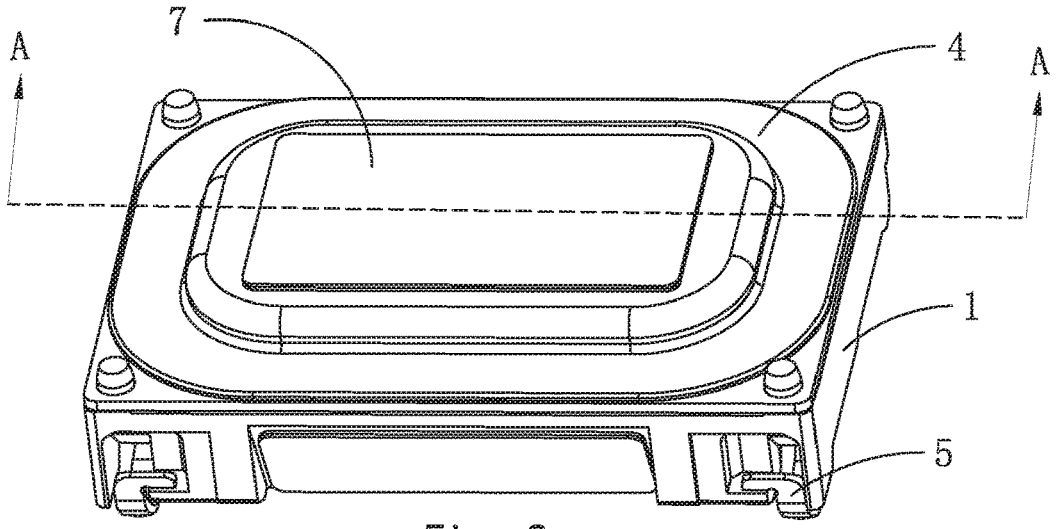
FIG. 2 is an isometric view of the sound generator in FIG. 1.
Figure 3:
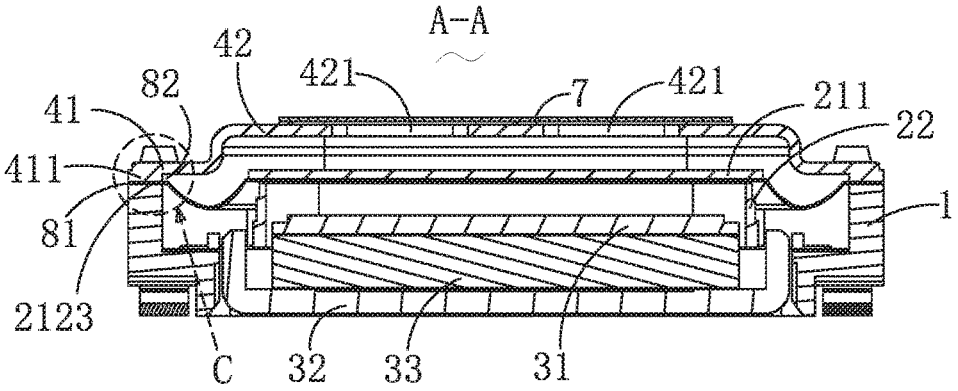
FIG. 3 is a cross-sectional view of the sound generator taken along line A-A in FIG. 1
Figure 4:
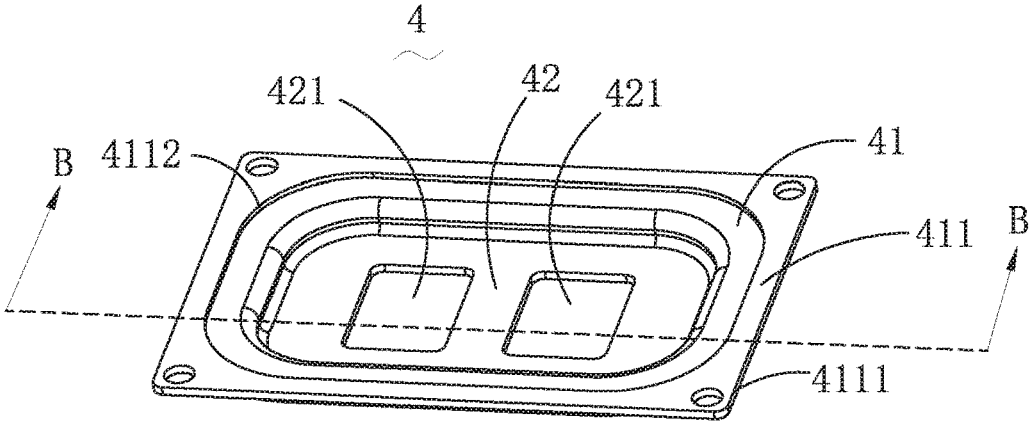
FIG. 4 is an isometric view of a front cover of the sound generator.
Figure 5:
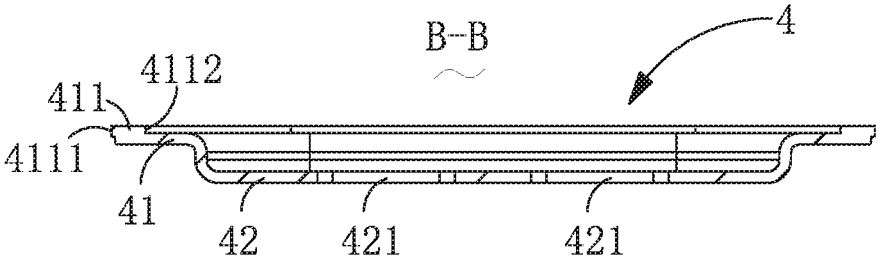
FIG. 5 is a cross-sectional view of the front cover taken along line B-B in FIG. 4.
Figure 6:
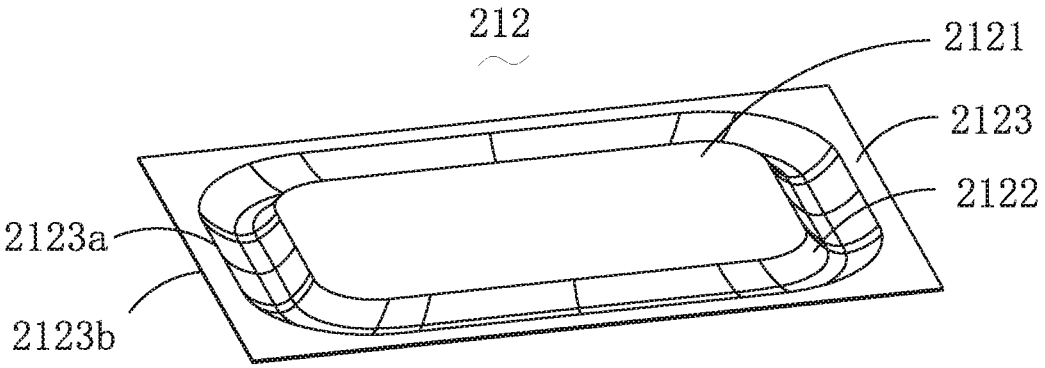
FIG. 6 is an isometric view of a suspension of the sound generator.
Figure 7:
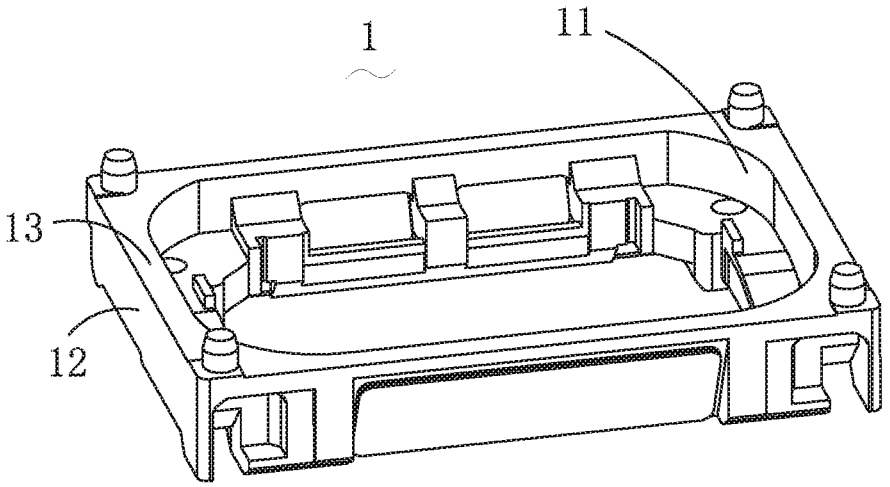
FIG. 7 is an isometric view of a frame of the sound generator.
Figure 8:
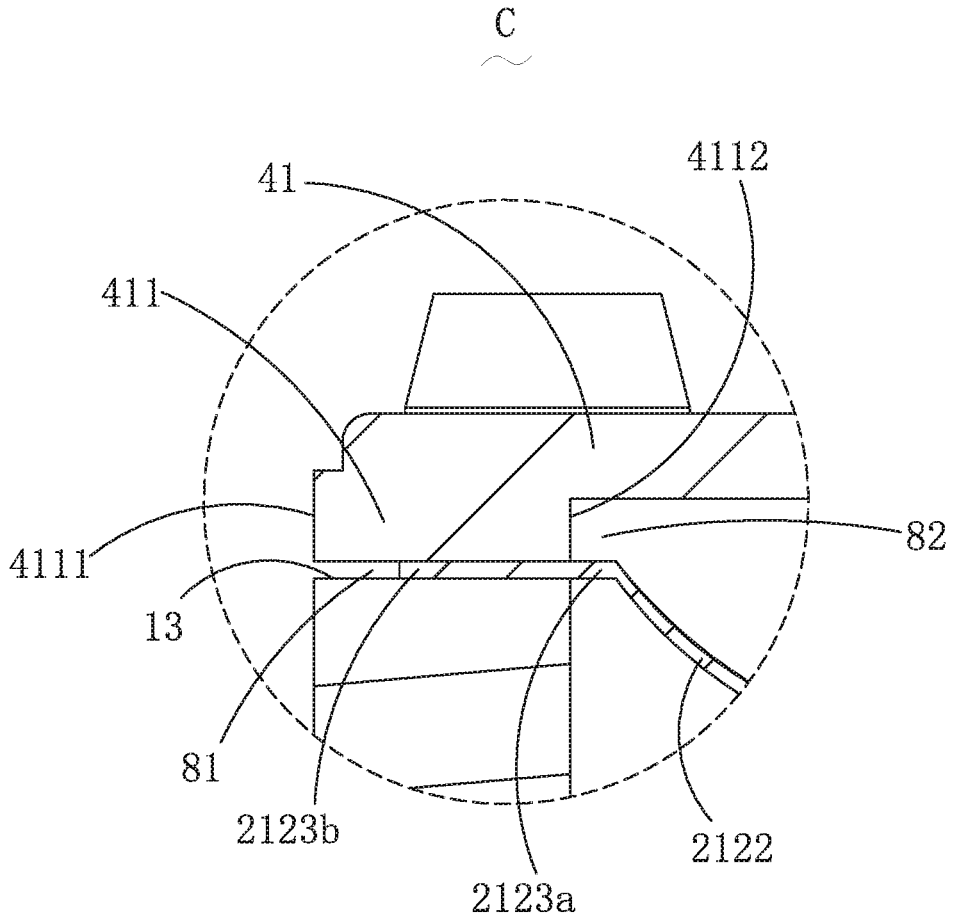
FIG. 8 is an enlarged view of Part C in FIG. 3.

Referring to FIGS. 1-8, the present disclosure provides an electroacoustic sound generator (hereinafter "sound generator") including a frame 1 with an accommodation space, a vibration system 2 received in the accommodation space, a magnetic circuit system 3 received in the accommodation space, a front cover 4 located above the front cover 4, and a plurality of conductive terminals 5 assembled with the frame 1.

The frame 1 includes an inner side 11 for bounding the accommodation space, an outer side 12 opposite to the inner side and away from a geometric center of the accommodation space, and an upper side 13 for connecting the inner side 11 and the outer side 12.

The vibration system 2 includes a diaphragm 21 and a coil assembly 22 for driving the diaphragm 21 to vibrate for generating sound. The coil assembly 22 is electrically connected to the conductive terminals.

The diaphragm 21 includes a suspension 212 and a dome 211 attached to the suspension 212. The suspension 212 includes a middle portion 2121 connecting to the some 211, a suspending portion 2122 extending from and surrounding the middle portion 2121, and positioning portion 2123 extending outwardly from and surrounding the suspending portion 2122. The positioning portion 2123 is sandwiched between the upper side 13 of the frame 1 and the front cover 4.

The magnetic circuit system 3 includes an upper plate 31, a magnetic yoke 32, and a magnet 33 carried by the magnetic yoke 32. The magnet 33 and the magnetic yoke 32 cooperatively form a magnetic gap for partially receiving the coil assembly 22. When electrified, the coil assembly 22 interacts with the magnetic field produced in the magnetic gap, and is forced to vibrate due to the Ampere Force. The vibration of the coil assembly 22 drives the diaphragm 21 to vibrate for generating and radiating sound. The upper plate 31 is attached to a top of the magnet 33, and is made from magnetic conductive materials, for gathering the magnetic flux and improving the magnetic induction performance.

The front cover 4 includes a cover body 42 opposite to the middle portion 2121, and an adhering portion 41 extending from and surrounding the cover body 42. The front cover 4 further includes a thickened layer 411 extending from the adhering portion 41 along a direction toward the frame 1. The thickened layer 411 connects to the positioning portion 2123. The positioning portion 2123 is sandwiched between the upper side 13 of the frame and the adhering portion 41. In the actual production process, the processing method of the thickened layer 411 includes the steps: stick the thickened layer material to the adhering portion with equal material thickness, and then press or extrude the stacked material to form the thickened layer with the required thickness and edge width through the a die. The thickness of the thickening layer and the width of the edge depend on the requirement of the whole structure design of the sound generator. In fact, it may also be changed during upsetting or extrusion process due to the amount of force applied to the die.

As an option, a hardness of the front cover 4 is 150-200 HV. More specifically, the front cover is made of soft stainless steel with hardness 150-200 HV. It will be easier to manufacture the front cover if the material of the front cover has lower hardness.

The thickened layer 411 includes a first side 4111 surrounding the adhering portion 41, and a second side 4112 opposite to the first side 4111 and adjacent to a geometric center of the adhering portion 41. The first side 4111 is coplanar with the outer side 12 of the frame 1, and the second side 4112 is coplanar with the inner side 11 of the frame 1.

The thickened layer 411 has a projection on the top side 13 of the frame 1 partially overlapping with a projection of the positioning portion 2123 on the top side 13 of the frame 1. Preferably, the thickened layer 411 engages with the positioning portion 2123 at stagger positions, by virtue of which, overflowing space for the glue is formed. Thus, the glue for engaging the thickened layer 411 and the positioning portion 2123 is prevented from overflowing out of the thickened layer 411 and the positioning portion 2123.

Alternatively, the positioning portion 2123 further includes a connecting end portion 2123*a* connecting to the suspending portion 2122, and a free end portion 2123*b* surrounding the connecting end portion 2123*a*. The connecting end portion 2123*a* is suspended between the frame 1 and the adhering portion 41, and the free end portion 2123*b* is sandwiched between the top side 13 of the frame and the thickened layer 411.

The free end portion 2123*b*, the top side 13 of the frame 1, and the thickened layer 411 cooperatively form a semi-sealed first receiving space 811; the connecting end portion 2123*a*, the second side 4112 of the thickened layer 411, and the adhering portion 41 cooperatively form a semi-sealed second receiving space 82. When the thickened layer 411 is adhered with the positioning portion 2123, excessive glue first flows into the first and second receiving spaces 81, 82, which effectively avoid the overflow, and improves the acoustic performance of the sound generator.

The front cover 4 further includes a sound outlet 421 formed in the cover body 42. For achieving dust-proof performance, the sound generator further includes a metal plate 6 and a permeable isolator 7 corresponding to the sound outlet 421. The permeable isolator 7 is disposed above the sound outlet 421, and the metal plate 6 is sandwiched between the permeable isolator 7 and the cover body 42 of the front cover 4.

The adhering portion of the electroacoustic sound generator provided by the present disclosure, for engaging the front cover and the diaphragm, includes the thickened layer for coupling with the diaphragm, which effectively avoid the glue from overflowing. The hardness of the adhering portion is 150~200 HV, which makes it easier to manufacture the thickened layer.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An electroacoustic sound generator, comprising:

a frame with an accommodation space;

a vibration system in the accommodation space, including a diaphragm with a suspension and a dome attached to the suspension, the suspension including:

a flat middle portion connected to the dome;

a ring-shaped suspending portion extending from the periphery of the middle portion and surrounding the middle portion; and a ring-shaped positioning portion extending from the periphery of the suspending portion away from the middle portion and surrounding the suspending portion;

a front cover located above the frame, including a cover body opposite to the middle portion and a adhering portion extending from and surrounding the cover body; wherein the positioning portion is sandwiched between the adhering portion and the frame; and the front cover further includes a thickened layer extending from the adhering layer along a direction toward the frame, and the thickened layer is connected to the positioning portion, the thickened layer glued with the positioning portion at stagger positions; wherein the frame includes an inner side for forming the accommodation space, an outer side opposite to the inner side and away from a geometric center of the accommodation space; the thickened layer includes a first side surrounding the adhering portion, and a second side opposite to the first side and adjacent to a geometric center of the adhering portion; the frame further includes a top side for connecting the inner side to the outer side; the positioning portion includes a connecting end portion connecting to the suspending portion and a free end portion surrounding the connecting end portion; the connecting end portion is suspended between the frame and the adhering portion, and the free end portion is sandwiched between the top side of the frame and the thickened layer;

the free end portion, the top side of the frame, and the thickened layer cooperatively form a semi-sealed first receiving space; the connecting end portion, the second side of the thickened layer, and the adhering portion cooperatively form a semi-sealed second receiving space.

2. The electroacoustic sound generator as described in claim 1, wherein the first side is coplanar with the outer side, and the second side is coplanar with the inner side.

3. The electroacoustic sound generator as described in claim 2, wherein a projection of the thickened layer on the top side is partially overlapping a projection of the positioning portion on the top side.

4. The electroacoustic sound generator as described in claim 3, wherein the front cover has a hardness 150~200 HV.

5. The electroacoustic sound generator as described in claim 2, wherein the front cover has a hardness 150~200 HV.

6. The electroacoustic sound generator as described in claim 1, wherein the front cover has a hardness 150~200 HV.

* * * * *